United States Patent [19]

Brinn et al.

[11] Patent Number: 4,547,704

[45] Date of Patent: Oct. 15, 1985

[54] HIGHER EFFICIENCY INCANDESCENT LIGHTING UNITS

[75] Inventors: Walter K. Brinn, Shaker Hts.; Ivan Berlec, South Euclid; John M. Davenport, Lyndhurst; Milan R. Vukcevich, Burton; Elmer G. Fridrich, Chardon, all of Ohio

[73] Assignee: General Electric Company, Schenectady, N.Y.

[21] Appl. No.: 519,162

[22] Filed: Aug. 1, 1983

[51] Int. Cl.[4] ..... H01J 7/44

[52] U.S. Cl. ..... 315/71; 313/579; 313/635

[58] Field of Search ..... 313/579, 580, 635; 315/71, 73, 72

[56] References Cited

U.S. PATENT DOCUMENTS

| | | | |
|---|---|---|---|
| 3,418,512 | 12/1968 | T'Jampens et al. | 313/579 X |
| 4,473,776 | 9/1984 | Peters | 315/71 X |
| 4,480,212 | 10/1984 | Monahan et al. | 315/71 |

*Primary Examiner*—Arthur Kellogg

*Attorney, Agent, or Firm*—J. P. McMahon; Philip L. Schlamp; Fred Jacob

[57] ABSTRACT

An improved high efficiency general service incandescent lighting unit is disclosed. The lamp has coaxial outer and inner envelopes. The inner envelope has a low voltage filament coaxially disposed therein, a halogen gas atmosphere and a fill-gas at a high pressure. The outer envelope has a coating of a light transmissive reflective infrared film on its inner surface. Further disclosed are various control systems for reducing a typical 120 v. A.C. voltage and applying the reduced A.C. or D.C. voltage across the low voltage filament within the inner envelope.

10 Claims, 10 Drawing Figures

The operation of a tungsten filament may be further improved relative to the efficacy of the incandescent lighting unit by housing the filament in a suitable efficient fill-gas, such as xenon, krypton or argon, raised to a relatively high pressure. The high pressure fill-gas improves the operation of the filament by reducing the evaporation of the tungsten material from the filament and by allowing the filament operating temperature to be higher for equal lamp life, thus contributing to improving the efficacy of the lamp. The arc-out resistance of the filament, that is, the resistance of the filament to being burned out by an arc condition, may be improved by the addition of nitrogen gas. In a manner as previously described for the halogen atmosphere, the related U.S. patent application Ser. No. 519,165 describes means, such as, a high pressure fill gas of xenon, krypton or argon preferably having nitrogen gas employed within a general service incandescent lamp for improving its efficacy. It is still considered desirable to provide a general service incandescent lighting unit utilizing the efficacy gain realized by the high pressure fill gas of the xenon, krypton or argon, and to improve the arc-out resistance of the filament by the addition of the nitrogen gas.

Still further, it is considered desirable to provide an adaptive housing containing the high pressure fill-gases having the nitrogen additive along with the halogen gas and a tungsten filament. The housing being adapted for easy insertion onto and removal from the general service incandescent lighting unit.

Further still, it is considered desirable to provide an infrared type film for a general service incandescent lighting unit in such a manner so as to be easily attached to or detached from a general service incandescent lighting unit under initial fabrication and replacement conditions respectively.

Accordingly, objects of the present invention are to provide a relatively inexpensive general service incandescent lighting unit having, (1) an infrared reflecting film that reflects infrared radiation concentrically to the lamp filament and transmits visible radiation, (2) an infrared reflecting film that is located at a position sufficiently remote from the filament of the general service incandescent lighting unit and in an advantageous atmosphere to avoid film degradation, (3) a filament along with its housing that is centrally located relative to the infrared radiation reflected by the infrared reflecting film, (4) a mechanically sturdy filament which maintains its central position relative to the reflected infrared radiation during the operation of the filament, (5) a low voltage filament operated at a reduced applied voltage while still maintaining its wattage and even improving lamp efficacy, (6) means internally located in the general service incandescent lighting unit for reducing the voltage that is applied to the low voltage filament, (7) a low voltage filament housed within an atmosphere comprised of a halogen and a relatively high pressure fill-gas such as xenon, krypton or argon, and nitrogen gas, (8) a light-transmissive infrared reflective film provided on a housing which is easily attachable to and detachable from the remainder of the general service incandescent lighting unit under initial fabrication and replacement conditions respectively, and (9) comprising a combination of the contributions from the infrared reflecting film, the advantageous location of the infrared film, the centrally located filament, the sturdy low voltage filament, the means for reducing the applied voltage, the housing of the filament having an atmosphere comprised of a halogen, a high pressure fill-gas such as xenon, krypton or argon and the nitrogen additive, and the infrared film on a housing having means so as to be easily attachable and detachable from the general service incandescent lighting unit, in such a manner that the overall effect of the combination is greater than expected gains anticipated from the individually contributing features.

These and other objects of the present invention will become apparent upon consideration of the following description of our invention.

SUMMARY OF THE INVENTION

In one embodiment of the present invention a general service incandescent lighting unit comprises: (a) a base having an electrically conductive screw-in section, (b) an outer envelope mounted on the base; (c) an inner envelope coaxially disposed within the outer envelope and containing a halogen gas atmosphere along with a high pressure fill-gas; (d) a filament coaxially disposed within the inner envelope; (e) an infrared reflecting film on the inner surface of the outer envelope, and effective during the operation of the lighting unit for substantially transmitting visible radiation and substantially reflecting toward the filament infrared radiation emitted by the filament, and; (f) means located in the base and effective during the operation of the lamp for applying a voltage having a value in the range of about 20 to less than about 120 volts across the filament.

The particular features of the invention believed to be novel are set forth with particularity in the appended claims. The invention itself, however, both as to its construction and operation, together with further objects and advantages thereof, may be best understood by reference to the following description taken in conjunction with the accompanying drawings.

HIGHER EFFICIENCY INCANDESCENT LIGHTING UNITS

CROSS REFERENCE TO RELATED APPLICATIONS

Figure 1:
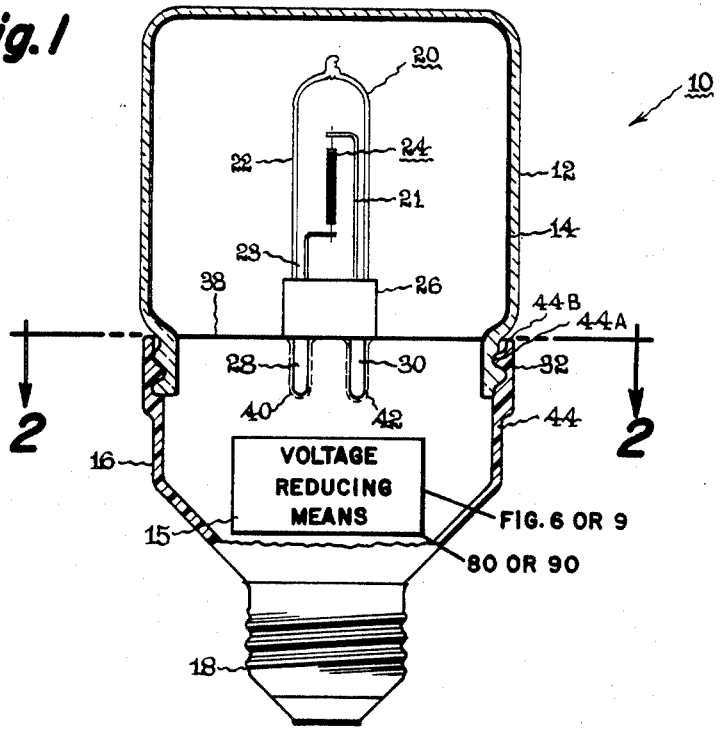
FIG. 1 shows a general service incandescent lamp in accordance with one embodiment of the present invention.

U.S. patent application Ser. Nos. 519,165; 519,164 and 519,163 filed concurrently herewith, respectively for "General Service Incandescent Lamp with Improved Efficiency" of I. Berlec, "Improved Incandescent Lamp" of C. Tschetter et al, and "Incandescent Lamp Source Utilizing an Integral Cylindrical Transparent Heat Mirror" of L. W. Otto, all assigned to the same assignee as the present invention, are all related to the present invention.

BACKGROUND OF THE INVENTION

This invention is related to a general service incandescent lighting unit, and more particularly, to a higher efficiency general service incandescent lighting unit having coaxial outer bulb and inner envelope with the inner envelope containing a halogen atmosphere along with a relatively high pressure fill-gas and a coaxially disposed low voltage filament therein.

The continuing pursuit of improving the efficiency of lamps is of increasing importance due to the increasing cost of energy. One of the family of lamps in which the efficiency is desired to be improved is the incandescent lamp. The incandescent lamps, although having efficiency ratings lower than those of fluorescent and high intensity discharge lamps, have many attractive features, such as, low cost, compact size, instant light, dimmability, convenience, pleasing spectral distribution, and millions of existing sockets in the homes of users who have become accustomed to the incandescent type lighting.

Incandescent lamps are of various types, the most well-known is the A-line which is typically termed a general service incandescent lamp having a wide range of wattage ratings. Still further, the general service incandescent lamp typically has a tungsten filament.

The tungsten filament is also commonly utilized in a relatively more expensive but more efficient special purpose halogen type lamps. In a typical operation over an extended period of time, some tungsten of the tungsten filament evaporates to the bulb wall, which, in turn, typically causes a darkening of the bulb wall, which, in turn, decreases the lumen output thereby decreasing the lumens per watt or efficacy of the lamp. It is known that the darkening of the bulb wall caused by the tungsten type filament may be substantially reduced by providing a halogen type gas atmosphere surrounding the tungsten type filament which provides a regenerative (transport) cycle that keeps the bulb wall clean resulting in improved efficacy or lumen output. The hereinbefore referenced U.S. patent application Ser. No. 519,165 describes means, such as, a halogen atmosphere employed within a general service incandescent lamp for improving its efficacy. It is still considered desirable that means for improving the efficacy, such as a halogen type atmosphere employed in a relatively expensive special purpose halogen type lamp be adapted to a general service incandescent lamp while maintaining the relatively inexpensive general purpose incandescent lamp.

Still further improvements are desired for relatively inexpensive incandescent type lamps. One such improvement is the use of an infrared reflecting film. The infrared type film operates so as to reflect the infrared type radiation back toward the filament while allowing the visible radiation to be emitted from the incandescent lamp. The infrared radiation is reflected back to the filament which recycles the energy that would be otherwise wasted, and, therefore, increases the efficacy of the general service incandescent type lamp. It is considered desirable to provide an incandescent lamp having an infrared type film.

Further still, with regard to an incandescent lamp having an infrared film to improve the operation of the filament, the desired operation of the infrared film must be taken into account with regard to the filament. For example, if the infrared film is comprised of an oxide, such as zinc oxide, in order to preserve the integrity the film it is desirable to locate and operate the film in an oxidizing atmosphere. Similarly, if the infrared film is comprised of a sulfide, such as zinc sulfide it is desirable to locate and operate the film in a nonoxidizing atmosphere. The desired operation of the infrared film may not be always achieved if the infrared film is subjected to a non-oxidizing atmosphere, typically provided by a fill-gas, such as xenon, krypton and argon, which are advantageous for the operation of the filament but not for an oxide infrared film. Accordingly, it is desired that the location of the infrared film of the general service incandescent lighting unit be provided with an atmosphere adapted to the desired operation of the particular infrared film.

Furthermore, with regard to the interrelationships between the infrared film, filament and the housing for the filament, the position of the filament relative to infrared radiation reflected by the infrared film must be considered. For example, it is desired that the filament be centrally located relative to the reflected infrared radiation so that the rays of infrared radiation emitted by the filament may be reflected by the infrared film in such a manner so as to impinge or strike the filament. Accordingly, it is desired that the filament along with its housing be centrally located relative to the infrared radiation reflected by the infrared film. This is accomplished by having the inner and outer envelopes and the filament coaxially disposed.

Further still, with regard to the positioning interrelationships between the infrared film and filament, the structural stability of the filament must be considered. For example, if a filament is initially advantageously centered with regard to the infrared reflected radiation, and then due to its operation experiences a distortion or sagging, the desired centering is degraded. Accordingly, it is desired that the filament be mechanically sturdy with a stable configuration type such as described in detail in the aforementioned U.S. Application Ser. No. 519,165.

The hereinbefore referred to U.S. patent application Ser. No. 519,165 describes a filament operated at a low voltage while maintaining the wattage and even increasing the efficacy of the general service incandescent lamp. It is still considered desirable to provide a filament that provides extended life and maintains the wattage of the lamp and even increases the efficacy of the incandescent lamp while operated at a low voltage.

Still further, it is considered desirable that the means for reducing the operating voltage be internally located within the housing of a general service incandesent lighting unit so as to form an integral device.

DETAILED DESCRIPTION OF THE PREFERRED EMBODIMENT

A general service incandescent lighting unit 10 is shown in FIG. 1 as comprising a base 16 having an electrically conductive screw-in section 18. An outer envelope 12 has a cylindrical shape and is mounted on the base 16. The lighting unit 10 further comprises an inner envelope 20 coaxially disposed within the outer envelope 12 and containing a halogen gas atmosphere along with a high pressure fill-gas. Coaxially disposed within the inner envelope 20 is a low voltage tungsten filament 24. An infrared reflecting film 14 is coating the inner surface of the outer envelope 12 and is effective during the operation of the lighting unit 10 for substantially transmitting visible radiation and substantially reflecting toward the filament 24 infrared radiation emitted by the filament 24. As will be described hereinafter, voltage reducing means 80 or 90 are (shown in FIG. 6 or 9, respectively,) located in the base 16 and are effective during the operation of the lamp 10 for applying a voltage having a value within the range of about 20 to less than about 120 A.C. or D.C. across the filament 24.

FIG. 1 shows the inner envelope 20 as comprising an outer glass or quartz member 22, the low voltage filament 24, a base 26, and two prong male type connectors 28 and 30. The male prongs 28 and 30 are easily insertable into respective mating female connectors 40 and 42, shown in phantom, located in the base 16 for lodging the electronic elements of the voltage reducing means 80 or 90. The female prongs 40 and 42 are connected to the voltage reducing means of FIG. 6 or 9 to be described, which, in turn, have appropriate connections to the electrical conductive screw-in section 18. The prongs 28 and 30 are electrically connected (not shown in FIG. 2) to opposite sides of filament 24 via leads 23 and 21.

FIG. 1 further shows the outer envelope 12 as having a jar-type shape. The outer envelope 12 has a screw-type mouth 32 which forms a male-type arrangement relative to a female-type screw section 44 in the base 16 so as to provide detachable coupling between the outer envelope 12 and the base 16. The female screw section 44 is shown in FIG. 1 as having an inner portion 44A, which complementarily mates with the mouth 32 of the outer envelope 12, and an outer portion 44B comprising the outer circumferential portion of socket 44. It should be noted that the detachability between the outer envelope 12 and the base 16 provides serviceability benefits for lamp 10 of FIG. 1. For example, if the filament 24 burns out, the inner envelope 20 may be replaced, thus allowing reuse of the other parts of the lamp 10. Also, if the outer envelope 12 is damaged it is easily detachable from the base 16 for replacement purposes eliminating the need of complete lamp replacement, and, similarly, if the base 16 including its contained electrical devices become defective, the base 16 need only be replaced.

The glass member 22 of inner envelope 20 of FIG. 1 has an inner chamber having a relatively small volumetric capacity, such as 5 c.c. The relatively small volume of the inner chamber is a complementary type characteristic for containing relatively expensive efficient fill-gases and halogen gas so as to provide a relatively inexpensive general service incandescent lamp. The efficient fill-gases and halogen gas surrounds the low voltage filament formed of a tungsten material 24. As discussed in the "Background" section, the halogen gas surrounding the low voltage tungsten filament provides a regenerative or transport cycle that keeps the walls of inner envelope 20 clean which, in turn, preserves the efficacy of the lamp 10 over its life.

The inner envelope 20 is formed of a relatively thick quartz or glass material having typical dimensions as those described in the related U.S. patent application Ser. No. 519,165 and to which reference can be made for further details of quartz or glass inner envelope 20. Still further, the inner envelope 20 contains a relatively high pressure fill-gas such as xenon, krypton, argon along with a preferably added nitrogen gas for arc-resistance purposes and all of which are described in the U.S. patent application Ser. No. 519,165 to which reference may be made for further details of the desired xenon, krypton, argon and nitrogen gases.

The low voltage filament 24 is of a mechanically sturdy type which is of importance with regard to its interrelationship with the operation, to be described, of infrared reflecting film 14. The low voltage filament 24 is similar to and is more completely described in the hereinbefore referenced related U.S. patent application Ser. No. 519,165 and to which reference may be made for further details.

As previously mentioned, the inner surface of the outer envelope 12 is covered with an infrared (IR) type film 14. The IR film 14 substantially transmits visible radiation and substantially reflects infrared radiation toward the lamp filament 24 during the operation of the lamp 10. The infrared radiation that is reflected back toward the filament which recycles the energy which would otherwise be wasted, and, therefore, increases the efficacy of the general service incandescent lighting unit 10.

The location of the IR film 14 on the inner surface of the outer envelope 12 is advantageous with regard to two factors, (1) the IR film 14 is remote from the relatively high temperatures of the operating filament 24, and (2) the IR film 14 may be provided with an appropriate atmosphere adapted to the characteristics of the particular IR film 14. Locating the IR film 14 remote from the operating filament 24 provides for a relatively low operating temperature, such as 200°, for the IR film 14 which is beneficial for its performance. Locating the IR film 14 on the inner walls of the outer envelope allows for providing an atmosphere that is preferentially selectable to the individual characteristic of various types of IR films. For example, as discussed in the "Background," if the IR film 14 is comprised of an oxide, such as zinc oxide, it is advantageous to provide an oxidizing operating atmosphere so as to preserve the oxidation characteristics of the film 14. This oxidizing atmosphere may be provided by simply allowing oxygen in the form of air to be contained within the inner confines of the outer envelope 12. Similarly, for an improved general service incandescent lighting unit 50 of FIG. 3 to be described hereinafter, if the IR film 14 is comprised of a sulfide, such as zinc sulfide, it is advantageous to provide a nonoxidizing operating atmosphere so as to preserve the nonoxidation characteristics of the film 14. The nonoxidizing atmosphere may be provided by simply restricting oxygen from within the inner confines of the outer envelope 52 by filling and sealing techniques for the outer envelope 52 of the lamp 50. The practice of the present invention adapts the inner environment of the general service incandescent lighting unit 10 and 50 to the desired operational parameters of the particular type of IR film 14. Still further, with regard to the desired operation of the infrared film 14, the filament 24 is centrally positioned relative to the total amount of infrared radiation reflected by the infrared film 14. The central positioning of filament 24 is provided by the insertion of the male type prongs 28 and 30 of the inner envelope 20, of FIG. 2, into the female type prongs 40 and 42 of the housing 16 shown in FIG. 2.

Figure 2:
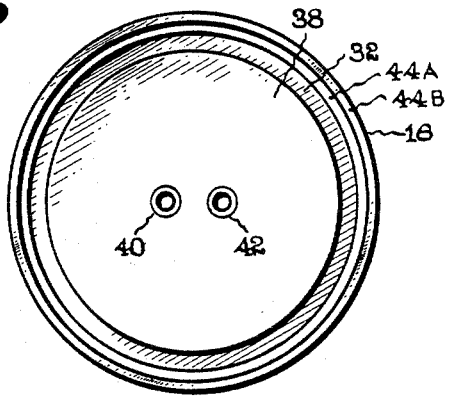
FIG. 2 shows the base of the lamp of FIG. 1 along lines 2—2 of FIG. 1.

More specifically, FIG. 2 taken along lines 2—2 of FIG. 1, shows a top view of base 16 as having inlets 40 and 42 for male prongs 28 and 30, respectively, of inner envelope 20 which is centrally located along the diameter of the base 16 so that when the inner envelope 20 is positioned into housing 16, by insertion of prongs 28 and 30, the filament 24 is coaxially centrally located relative to a cylindrical infrared radiation reflective surface defined by the infrared film 14. The central position of filament 24 allows a major portion of the rays of infrared radiation reflected by the infrared film to be directed back toward the filament 24 and for impinging upon the filament 24, which, in turn, increases the operating efficacy of the filament 24. The increased operating temperature provides, (1) an improved operation by an increased temperature of the filament 24, which, in turn, contributes to improving the efficacy of the general service incandescent lighting unit 10, and (2) decreases the input power needed to obtain the desired operation of the filament 24, which, in turn, decreases the amount of input power required for the general service incandescent lighting unit 10.

Still further, with regard to the interrelationship between the (IR) film 14 and the filament 24, the mechanically sturdy characteristic of the filament 24 is of importance relative to the IR rays reflected by the IR reflecting film 14. The filament 24 due to its mechanically sturdy structure maintains its orientation relative to its central position during operation even when it is subjected to a normal relatively high operating temperature. The stable orientation of filament 24 provides for a maintained position of filament so as to be impinged by a major portion of infrared rays reflected by the IR film 14 during the operation of the general service incandescent lighting unit 10.

The IR film 14 may be of a reflective type such as disclosed in either (1) U.S. Pat. No. 4,229,066 of J. D. Rancourt et al, (2) U.S. Pat. No. 4,017,758 of Almer et al, (3) U.S. Pat. No. 3,901,997 of R. Groth, or (4) U.S. Pat. No. 4,187,336.

FIG. 2 shows the base housing 16 as having a coating 38 provided on its upper surface. The coating 38 is of an infrared reflecting type and may be of the same type as that of infrared reflective film 14. The infrared reflecting coating 38 provides an additional means for reflecting the infared radiation impinging upon its surface back toward the filament 24 so as to further elevate the filament efficiency in a desired manner, which, in turn, further increases the efficacy of lamp 10 of FIG. 1.

Figure 3:
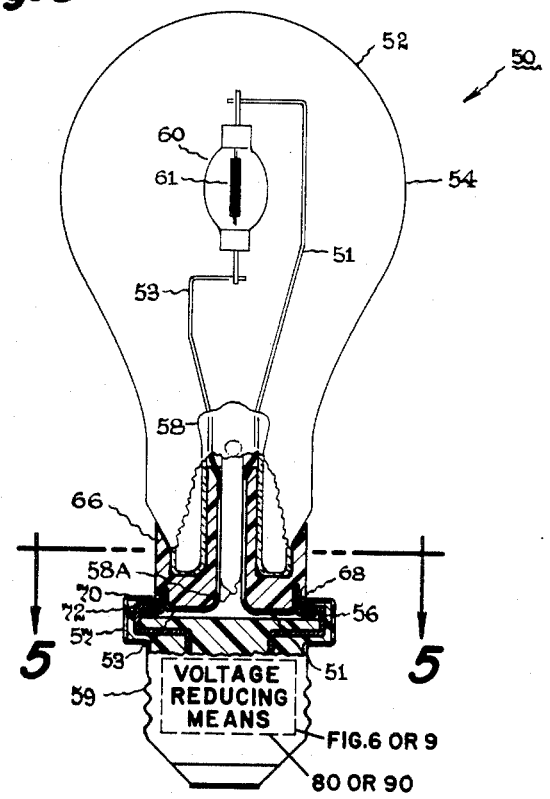
FIG. 3 shows a general service incandescent lamp according to another embodiment of the present invention.

FIG. 3 shows a general service incandescent lighting unit 50 as having an outer envelope 52 which is of the well-known A-type shape. The outer envelope 52 has an infrared film 54 formed of the same composition previously described for the infrared film 14 of the outer envelope 12 of the lamp 10 of FIG. 1. Similarly, the general service incandescent lighting unit 50 has an inner envelope 60 having coaxially disposed therein a low voltage filament 61 both formed of similar materials and having similar dimensions as their respective elements of those described for inner envelope 20. Unlike the inner envelope 20 of FIG. 1, the inner envelope 60 is rigidly affixed within the lamp 50 of FIG. 3 instead of being plugged into a base.

The inner envelope 60 is rigidly attached to the stem 58 by electrical conductors 51 and 53, which, in turn, are connected to opposite ends of filament 61 by appropriate inleads of inner envelope 60. The rigidly attached inner envelope 60 is axially aligned in such a manner that the filament 61 is centrally positioned relative to the film 54 and focused relative to the infrared rays reflected by the film 54 in a similar manner to that described for the filament 24 of lamp 10.

The outer envelope 52 in the present embodiment can be detachably decoupled from the electrically conductive base 57 having a screw-in section 59. The electrically conductive base 57 provides a housing for lodging the electrical components of the circuit arrangements of FIG. 6 or FIG. 9 to be described.

The inlead 51 is shown in FIG. 3 as connected to the voltage control means by an electrical path provided by a contact 68 and a base contact 56. Similarly, inlead 53 is shown in FIG. 3 as connected to the voltage control means by an electrical path provided by a contact 70 and a base contact 72. The inleads 51 and 53 are further shown in FIG. 3 as extending through stem 58 and having a path contacting a plastic insulator 66 shown more clearly in FIG. 4.

Figure 4:
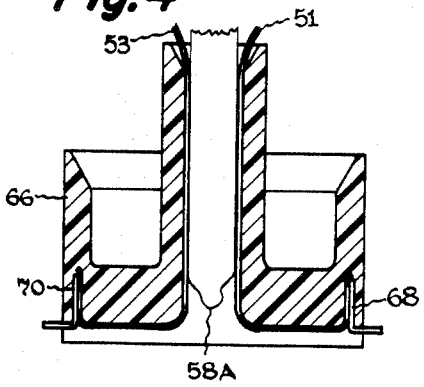
FIG. 4 shows the arrangement of the insulator of FIG. 3.

FIG. 4 shows the inleads 51 and 53 as having a path which is between and along an inner cavity of the plastic insulator 66 and the lower section of the stem 58 having a tip portion 58A. The inleads 51 and 53 are shown as respectively connected to lamp contacts 68 and 70 at inlets appropriately provided in the plastic insulator 66. The plastic insulator 66, as shown in FIG. 3, provides insulation so as to prevent the inleads 51 and 53, the lamp contacts 68 and 70, and the base contacts 56 and 72 from contacting base 57.

The plastic insulator 66 may be mated to the outer envelope 52 having the stem 58 by initially applying an appropriate cement to the upper portion of the plastic insulator 66 and then press-fitting the plastic insulator 66 into the mating sections of the outer envelope 52 and the stem 58. The coupling or attachment of the outer envelope 54 and plastic insulator 66 to the base 57 is best described with reference to FIG. 5.

Figure 5:
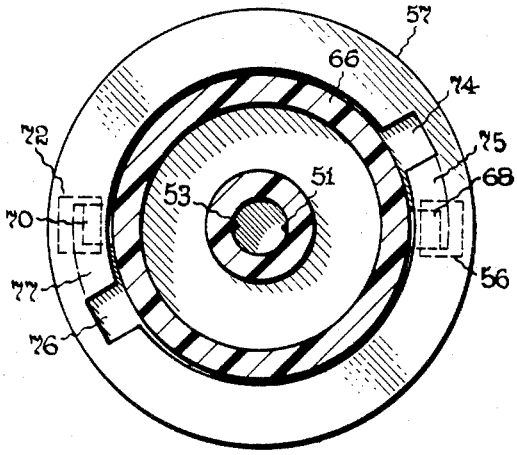
FIG. 5 shows the attachment of the outer envelope to the base of the lamp of FIG. 3 along lines 5—5 of FIG. 3.

FIG. 5 is a top view along lines 5—5 of FIG. 3. FIG. 5 shows the plastic insulator 66 within the confines of the base 57, the inleads 51 and 53 of inner envelope 60 centrally located along the diameter of the base 57, an entrance opening 74 to a channel 75 both of base 57, an entrance opening 76 to a channel 77 both of base 57, and the lamp contacts 68 and 70. The ears 68 and 70 are then rotated clockwise into channels 75 and 77 and abut against terminal portions of channels 75 and 77, respectively. At these abutting positions the ears 68 and 70 make electrical contact with base contacts 56 and 72, respectively. The confinement of the ears 68 and 70 within channels 75 and 77 and contacting the base contacts 56 and 72 connects, in a mechanical and electrical manner, the outer envelope 54, having the coaxially disposed inner envelope 60, to the base 57.

It should now be appreciated that the present invention in its various embodiments provides a general service incandescent lighting unit with deetachability between its outer envelopes 52 and 12 and its bases 57 and 16, respectively. Still further, the present invention comprises inner envelopes 20 and 60 each having spatially disposed therein low-voltage filaments 24 and 61 respectively. As previously discussed, the present invention comprises means located within base 16 of FIG. 1 or within the electrical conductive base 57 of FIG. 6 for developing the low-voltage excitation for the low voltage filaments 24 and 61. For one embodiment of the present invention the means for developing the low voltage excitation has a circuit arrangement 80 shown in FIG. 6.

Figure 6:
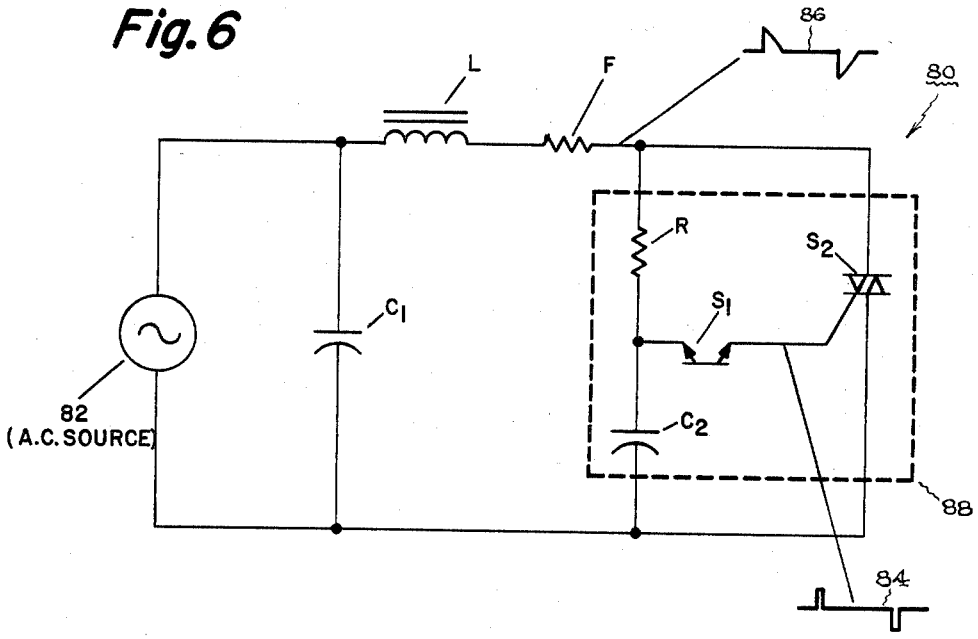
FIG. 6 shows a diagram of one embodiment for reducing a typical 120 volt A.C. source and controlling and applying the reduced voltage across the low voltage filament.

In general, the circuit arrangement 80 reduces the amplitude of the typical supply voltage, such as 120 v. A.C., normally used to excite the filament of a general service incandescent lamp and applies a reduced A.C. voltage across the low-voltage filament of the present invention. The circuit arrangement 80 of FIG. 6 is effective during the operation of the lamp for applying a root means square (R.M.S.) voltage between the range of about 20 to less than about 120 volts A.C. across the filament 24 or 61 schematically shown as F.

The circuit arrangement 80 is comprised of a plurality of elements of the typical types and of typical values given in Table 1.

TABLE 1

| Element | Type or Value |
|---|---|
| L | 10 μh |
| $C_1$ | 0.1 μf |
| R | 155 K Ω |
| $C_2$ | 0.1 μf |
| $S_1$ | DIAC device of the General Electric Co. (GE) type ST-2 |
| $S_2$ | TRIAC device (RCA) type T2800D |

The inductor L connected to one side of the applied A.C. source 82 provides an impedance to slow the rate of rise of the current typically occurring at the initial turn-on of the lamp 10 so as to prevent damage to the switch $S_2$. Together with the capacitor $C_1$ connected across the A.C. source 82 the inductor L provides an impedance for reducing electromagnetic interference (EMI).

The resistor R, capacitor $C_2$, and switches $S_1$ and $S_2$ comprise a voltage control 88 and are arranged in a similar manner as shown on page 192 as a DIAC-TRIAC PHASE CONTROL NETWORK of the General Electric Company SCR Manual, published in 1979.

In general, the circuit arrangement 80 applies an A.C. R.M.S. voltage in the range of about 20 to less than about 120 volts across the filament. The voltage that is applied across the filament is determined by the values of $R_1$, $C_2$ and the breakover voltage of the diac $S_1$. When the voltage across the capacitor $C_2$ reaches the breakover voltage of the diac $S_1$, a bi-directional trigger diode, $C_2$ is partially discharged through the diac $S_1$ into the gate of triac $S_2$. This discharge triggers the triac $S_2$ into its conduction mode.

Figure 7:
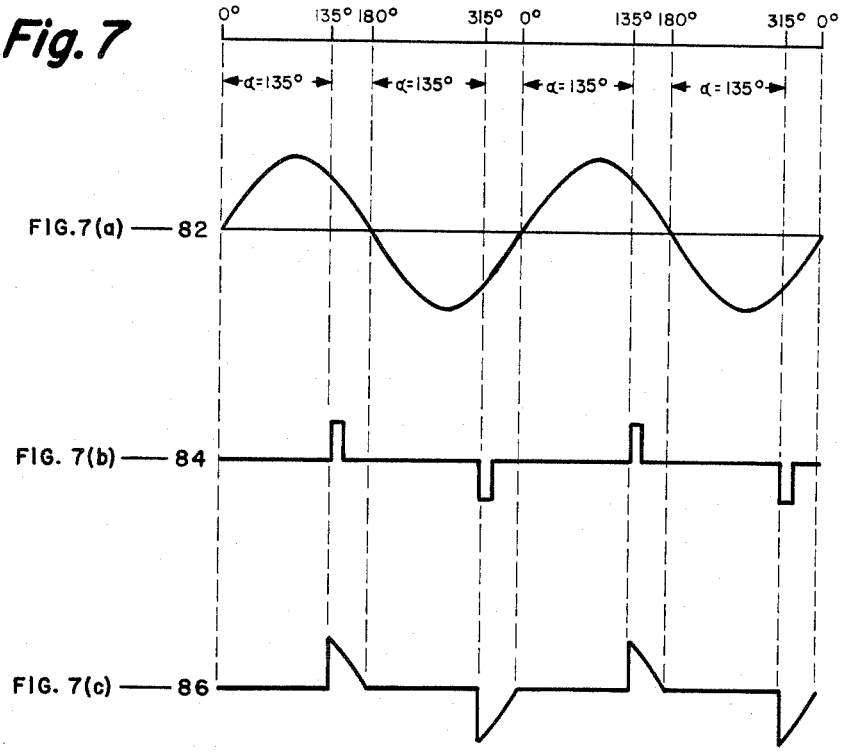
FIG. 7 is a timing diagram related to the operation of the circuit arrangement of FIG. 6.

The operation of the circuit arrangement is best described with reference to FIG. 7. FIG. 7 is segmented into three (3) portions, (1) FIG. 7(*a*) showing the waveform of the A.C. source voltage 82 along with the phase angle α of triggering the switching means $S_1$, and $S_2$, (2) FIG. 7(*b*) showing the triggering signal 84 generated by switching means $S_1$ which is applied to the gate of switching means $S_2$, and (3) FIG. 7(*c*) showing the A.C. voltage 86 which is applied across the filament F.

FIG. 7(*a*) shows a phase angle α of triggering of about 135° measured from the 0° and 180° phase angle relationships of the A.C. source voltage 82 shown in the uppermost portion of FIG. 7. From FIGS. 7(*a*), (*b*) and (*c*) it is respectively seen that the phase angle α of triggering of 135° of FIG. 7(*a*) corresponds to the transition of the generation of the triggering signal 84 of FIG. 7(*b*) and to the transition of the generation of the voltage 86 which is applied across the filament F. From FIGS. 7(*a*) and 7(*c*) it is seen that voltage 82 has periodic occurrence of a duration initiated by the phase angle α of triggering of 135° and terminated by the A.C. source voltage 82 of FIG. 7(*a*) transitions through its zero conditions.

The 135° of the phase angle α of triggering is obtained by appropriate selection of values of R and $C_2$ having typical values of 155K Ω and 0.1 μf respectively. The 135° of the phase angle α of triggering causes the voltage 86 applied across the filament F to be about 38 volts. The phase angle α of triggering may be selected to have various values from 0° to 180° shown in FIG. 8.

Figure 8:
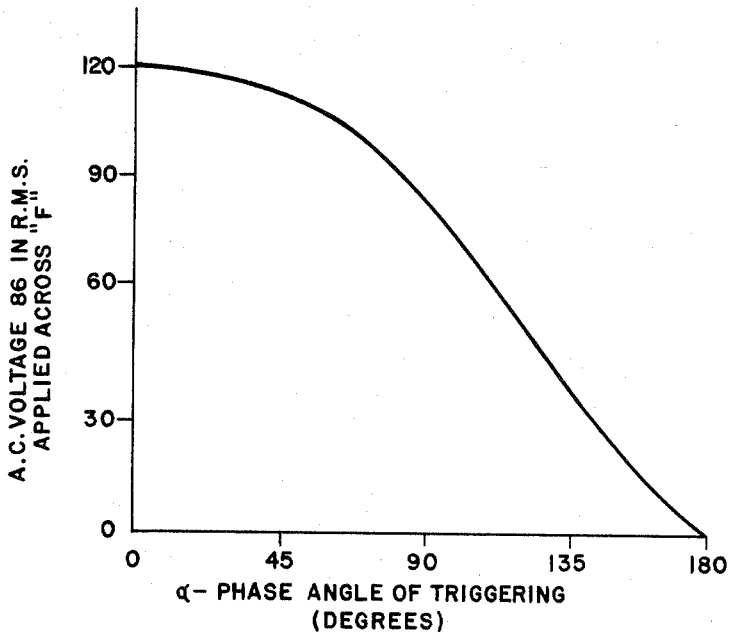
FIG. 8 is a curve of the phase angle $\alpha$ of triggering related to the timing diagram of FIG. 7.

FIG. 8 has as its x axis the phase angle α of triggering given in degrees from 0° to 180° and its Y axis as the A.C. voltage 82 applied across the filament $F_1$ given in R.M.S. volts. From FIG. 8 it is seen that the phase angle α of triggering may be selected from 0° to 180° and correspondingly causes the A.C. voltage 86 to vary from 120 volts to 0 volts.

Although the present invention has a low-voltage filament capable of being operated with an applied voltage in the range of greater than 0 volts and less than 120 volts in one embodiment it is preferred that the A.C. voltage applied across the filament be in the range of about 20 to about 40 R.M.S. volts A.C.

Figure 9:
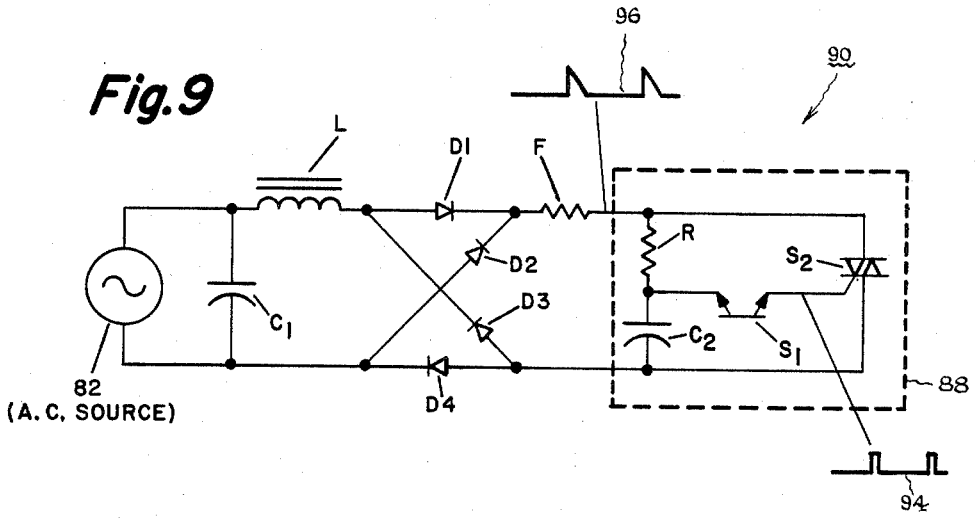
FIG. 9 is a second circuit arrangement for reducing a typical 120 volt A.C. source voltage and controlling the reduced voltage which is applied across the low voltage filament.

A second circuit arrangement for applying the desired voltage across the low voltage filament is shown in FIG. 9 and is designated 90.

In general, the circuit arrangement 90 of FIG. 9 operates in a manner different from the circuit arrangement 80 of FIG. 6 in that circuit arrangement 80 is directly coupled to the A.C. source 82, whereas, circuit arrangement 90 is coupled, in part, to the A.C. source 82 by a full-wave bridge diode arrangement shown as diodes D1, D2, D3, and D4. Circuit arrangement 90 is similar to circuit arrangement 80 with the exception that diodes D1, D2, D3, and D4 arranged into a full-wave rectifier is interposed between the output stage comprised of the filament and voltage control 88 and the input stage comprised of inductor L and capacitor $C_1$ as shown in FIG. 9.

Figure 10:
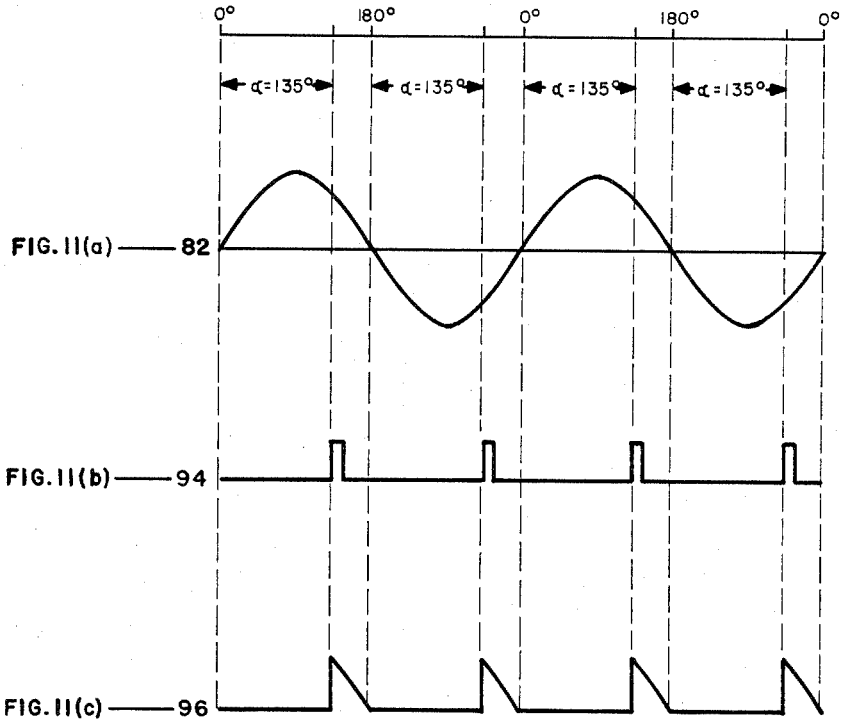
FIG. 10 is a timing diagram related to the operation of the circuit of FIG. 9.

The operation of the circuit arrangement 90 is best described with reference to FIG. 10. FIG. 10 is similar to FIG. 7 and is segmented into three (3) portions, (1) FIG. 10(*a*) showing the waveform of the A.C. source 82 along with the phase angle α of triggering the switching means $S_1$ both described for FIG. 7(*a*), (2) FIG. 10(*b*) showing the triggering signal 94 generated by switching means $S_1$ which is applied to the gate of switching means $S_2$, and (3) FIG. 10(*c*) showing the D.C. voltage 96 which is applied across the filament F.

A comparison between FIGS. 7(*b*) and 7(*c*) and FIGS. 10(*b*) and 10(*c*) reveals quite similar waveforms with the differences being that signals 84 (FIG. 7(*b*)) and 86 (FIG. 7(*c*)) are positive and negative going signals, whereas, signals 94 (FIG. 10(*b*)) and 96 (FIG. 10(*c*)) are only of the positive type signals. The positive type signals 94 and 96 are developed by the circuit arrangement 90 having the full-wave rectifier diodes D1, D2, D3 and D4 interposed between the input and output stages as previously described.

In a manner similar to that previously described for FIG. 7(*a*), FIG. 10(*a*) shows a phase angle $\alpha$ of triggering of 135° which is obtained by appropriate selection of values of R and $C_2$ so as to cause voltage 96 having a value of 38 volts D.C. to be applied across filament F. The appropriate values of R and $C_2$ for this $\alpha = 135°$ are 270K $\Omega$ and 0.1 $\mu$f, respectively. Further, the phase angle $\alpha$ of triggering may be selected to have various values from 0° to 180° in a manner as previously described for FIG. 8 so as to obtain a D.C. voltage 96 in a desired range of about 20 to about less than 120 volts D.C. Although the present invention has a low voltage filament capable of being operated with an applied D.C. voltage, of about 20 to less than 120 volts D.C. it is preferred the D.C. voltage applied across the filament be in the range of about 20 to about 40 volts.

It should now be appreciated that the practice of the present invention provides various circuit arrangements for accepting an applied A.C. voltage source and either, (1) converting and reducing the A.C. voltage to a D.C. voltage in the range of about 20 to less than about 120 volts D.C. for application across the filament, or (2) reducing the A.C. voltage to a value in the range of about 20 to less than 120 volts A.C. for application across the filament. The A.C. or D.C. applied across the low-voltage filament in cooperation with the dimensions of the low-voltage filament provides a general service incandescent lighting unit with improved efficacy. The total improvements provided by this invention for the general service incandescent lighting unit were beyond the expected gains anticipated from previous experience as usually realized from the individually contributing features. Further, the contributing features complement each other. The practice of the present invention utilizes a low-voltage filament having relatively small dimensions so as to be complementary placed within a relatively small housing. The relatively small housing is complementary to reducing the desired amount of the relatively expensive halogen and fill-gases all of which gases enhance the efficacy of the lamp. The filament along with its housing is centrally located relative to the infrared radiation reflected by the infrared reflecting film further enhances the efficacy of the lamp. The low-voltage filament within the relatively small housing is a mechanically sturdy filament which maintains its central position relative to the reflected infrared radiation during the operation of the filament so as to provide enhanced efficacy during the life of the lamp. Further, the practice of this invention recognizes that by placing the infrared reflecting film at a location remote from the relatively hot filament and in an appropriate atmosphere selected for the characteristics of the operation of the infrared film itself, the operation of infrared film is enhanced, which, in turn, enhances the efficacy of the lamp. Furthermore, the infrared film is provided on an outer envelope that is easily mounted to or detached from the remainder of the general service incandescent lighting unit under respective initial fabrication and replacement conditions. The efficacy of the general service incandescent lighting unit of the present invention is further enhanced by operating the filament at a voltage reduced from the typical 120 volts A.C. source and the means for reducing the voltage is accomplished in a complementary manner so as to be an integral part of the lamp by being located in the base.

What we claim as new and desire to secure by Letters Patent of the United States is:

1. A general service incandescent lighting unit comprising:

(a) a base having an electrically conductive screw-in section;

(b) an outer envelope mounted on said base;

(c) an inner envelope coaxially disposed within said outer envelope and containing a halogen gas atmosphere along with a high pressure fill-gas;

(d) a filament coaxially disposed within said inner envelope;

(e) an infrared reflecting film coating the inner surface of said outer envelope and effective during the operation of said lighting unit for substantially transmitting visible radiation and substantially reflecting toward said filament infrared radiation emitted by said filament, and;

(f) voltage reducing means located in said base having means responsive to a predetermined phase angle of a voltage having a value of about 115 volts A.C. and being effective during the operation of said lamp for developing and applying a voltage having a value determined by said phase angle within the range of about 20 to less than about 90 volts A.C. or D.C. across said filament;

said outer envelope having means for connecting to said base which has means for complementary acceptance of said outer envelope, said means for connecting being designed in such a manner so as to be detachable from said base without causing damage to either of said base, said outer envelope or to electrical connections between said voltage reducing means and said filament.

2. A general service incandescent lighting unit according to claim 1 wherein said means of connecting of said outer envelope to said base is designed in such a manner as to be detachable from said base by a twisting action.

3. A general service incandescent lighting unit according to claim 2 wherein said outer envelope has a jar-type shape and a screw-type mouth base, and said base has a female type section for complementary acceptance of said screw-type mouth.

4. A general service incandescent lighting unit according to claim 1 wherein said outer envelope has an A-type shape.

5. A general service incandescent lighting unit according to claim 1 wherein said inner envelope has a base having affixed male-type prong connectors and said base has complementary female connectors, said base further having a transverse surface having a coating effective for reflecting toward said filament infrared radiation emitted by said filament.

6. A general service incandescent lighting unit comprising:

(a) a base having an electrically conductive screw-in section;

(b) an outer envelope mounted on said base;

(c) an inner envelope coaxially disposed within said outer envelope and containing a halogen gas atmosphere along with a high pressure fill-gas;

(d) a filament coaxially disposed within said inner envelope;

(e) an infrared reflecting film coating the inner surface of said outer envelope and effective during the operation of said lighting unit for substantially transmitting visible radiation and substantially reflecting toward said filament infrared radiation emitted by said filament, and;

(f) means located in said base and being effective during said operation of said lamp for applying a voltage having a value within the range of about 20 to less than about 120 volts A.C. or D.C. across said filament;

wherein said outer envelope having said coaxially disposed inner envelope has a stem for rigidly affixing a portion of the inleads for said inner envelope and allowing passage of the remainder portion of said inleads to coupling means attachable to said outer envelope, said coupling means having ears for respectively connecting to one end of each of the leads, said base having portions to related channels on its upper surface for accepting said ears so that upon the rotation of said outer envelope, said channel provides a passageway for accepting and connecting in an electrical and mechanical manner said outer envelope to said base.

7. A general service incandescent lighting unit according to claim 1 wherein said voltage reducing means effective during the operation of said lamp for developing and applying said voltage comprises:

phase control means interposed between said filament and an A.C. source of about 115 volts capable of energizing said lamp, said phase control means having means responsive to said predetermined phase angle of the voltage having a value of about 115 volts A.C. for triggering said phase control means which responsively develops an output signal by reducing the voltage of said A.C. source to said range of about 20 to less than 90 A.C. volts which is applied across said filament.

8. A general service incandescent lighting unit according to claim 7 wherein said means for applying said A.C. voltage across said filament preferably applies a voltage in the range of 20 to 40 volts A.C.

9. A general service incandescent lighting unit according to claim 1 wherein said voltage reducing means effective during the operation of said lamp for developing and applying said voltage comprises:

rectifying means interposed between said filament and an A.C. source of about 115 volts A.C. capable of energizing said lamp and developing a rectified D.C. voltage signal; and phase control means having as its input said rectified D.C. voltage signal, said phase control means having means responsive to said predetermined phase angle of the voltage having a value of about 115 volts A.C. for triggering said phase control means which responsively develops an output signal by reducing the voltage of said rectified D.C. voltage signal to said range of 20 to less than 90 volts D.C. which is applied across said filament.

10. A general service incandescent lighting unit according to claim 9 wherein said means for applying said D.C. voltage across said filament preferably applies a voltage in the range of 20 to 40 volts D.C.

* * * * *